US005293972A

United States Patent [19]

Krumholz

[11] Patent Number: 5,293,972

[45] Date of Patent: Mar. 15, 1994

[54] HYDRAULICALLY OPERATED PRESS BRAKE

[75] Inventor: Waldemar Krumholz, Hinwil, Switzerland

[73] Assignee: M+S Brugg AG, Brugg, Switzerland

[21] Appl. No.: 971,294

[22] Filed: Nov. 4, 1992

[30] Foreign Application Priority Data

Nov. 21, 1991 [DE] Fed. Rep. of Germany ..... 4138286

[51] Int. Cl.[5] ..... B21D 5/01

[52] U.S. Cl. ..... 188/371; 72/389

[58] Field of Search ..... 188/266, 371; 72/389, 72/465, 478, 482

[56] References Cited

U.S. PATENT DOCUMENTS

| | | | |
|---|---|---|---|
| 4,045,995 | 9/1977 | Sparks | 72/389 |
| 4,426,873 | 1/1984 | Pearson et al. | 72/389 |
| 4,449,389 | 5/1984 | Cros | 72/389 |
| 4,580,434 | 4/1986 | Graf | 72/389 |
| 5,067,340 | 11/1991 | MacGregor | 72/389 |
| 5,193,452 | 3/1993 | Dieperink | 72/389 |

FOREIGN PATENT DOCUMENTS

| | | | |
|---|---|---|---|
| 0612808 | 1/1961 | Canada | 72/389 |
| 0016637 | 7/1968 | Japan | 72/389 |
| 0261623 | 12/1985 | Japan | 72/389 |
| 9103333 | 3/1991 | PCT Int'l Appl. | 72/389 |

*Primary Examiner*—Mark T. Le

*Attorney, Agent, or Firm*—Tarolli, Sundheim & Covell

[57] ABSTRACT

The invention provides a hydraulically operated press brake with a vertically displaceable upper pressure ram member. The pressing force is induced in the region of the two lateral ends thereof. A cooperating stationary ram member is arranged opposite to the movable ram member and is freely suspended in the region of its two lateral ends. The upper movable ram member is subdivided into two portions, whereby the two portions rest on each other at a centrally located contact area. From this contact area, two gaps extend approximately horizontally, both having increasing width from the contact area to the lateral ends of the ram member. The pressing power is induced into the upper ram member portion. Thus, it can be achieved that the upper ram member and the lower ram member are deflected in the same sense under load such that the deflection lines run essentially parallel to each other.

17 Claims, 4 Drawing Sheets

HYDRAULICALLY OPERATED PRESS BRAKE

FIELD OF THE INVENTION

The present invention relates to a hydraulically operated press brake comprising a frame structure, a pressure ram member mounted in the frame structure to be vertically movable, a stationary ram member mounted in the frame structure, and at least two operating cylinders mounted in the frame structure and operatively connected to the pressure ram member in the region of the two lateral ends thereof for driving the pressure ram member to a motion against the stationary ram member and for retracting the pressure ram member vertically back from the stationary ram member.

Particularly, the invention relates to a press brake of the kind mentioned above in which the pressure ram member and the stationary ram member are mounted one above the other one, in which the pressure force is transmitted to the pressure ram member in the region of the two lateral ends thereof and in which the stationary ram member is freely supported in the region of its two lateral ends.

As is well known to any person skilled in the art, such press brakes show the disadvantage that the movable pressure ram member and the stationary ram member are deflected in opposite directions under load with the result that an uneven working gap between the movable pressure ram member and the stationary ram member is created. This disadvantage is particularly pronounced in big press brakes having a working area which is several meters in width and, in particular, if work pieces have to be bent the width of which being considerably smaller than the maximum working width.

Different measures have been proposed in the prior art which have as a goal to ensure an even working gap over the entire working width of the press brake by correcting the deflection line of at least one of the ram members and by compensating for the deviations of the deflection lines of the upper and lower ram member as far as the parallelism thereof is concerned, respectively. The common basic idea of all these measures known in the prior art is to adapt the course of the deflection line of the upper ram member, i.e. the movable pressure ram member, to the course of the deflection line of the lower, i.e. the stationary ram member, by generating load-dependent counter forces in the upper pressure ram member.

According to a solution well known in the art concerning press brakes of this kind, the lower portion of the upper movable pressure ram member is horizontally subdivided in several ram member elements which each cooperate with a separate operating cylinder and the pressing forces exerted by the individual ram member elements being controllable according to the load to which the assigned ram member element is subjected. Furthermore, the so called hydro cushion design usable for adapting the load distribution to the individual ram member elements have been used in the art for this purpose.

All these known solutions have the common disadvantage the the means for providing the required counterforces and the means for controlling the counter forces in dependance of the always changing load distribution conditions are extremely lavish, complicated and costly and, thereby, render the manufacture and the operation of such press brakes very expensive.

OBJECTS OF THE INVENTION

It is an object of the invention to provide a press brake of the kind referred to hereinbefore which avoids the disadvantages of the known press brakes and ensures that the working gap always remains even along the entire operating width of the press brake.

It is a further object of the invention to provide a press brake of the kind referred to hereinbefore which ensures that the inevitable deflection of the ram members under load is compensated for such that the deflection lines of the upper movable pressure ram member and the one of the lower stationary ram member run parallel to each other along the entire width of the press brake.

It is a still further object of the invention to provide a press brake of the kind referred to hereinbefore which provides for a working gap between upper movable pressure ram member and lower stationary ram member which has even width along the entire width of the press brake with simple and inexpensive means.

SUMMARY OF THE INVENTION

To achieve these and other objects, the present invention provides, according to a first aspect, a hydraulically operated press brake comprising a frame structure, a pressure ram member mounted in the frame structure to be vertically movable, and a stationary ram member mounted in the frame structure. The pressure ram member is divided into a first upper portion and a second lower portion along a plane essentially running perpendicular to the direction of motion of the pressure ram member.

Both the upper portion and the lower portion of the pressure ram member comprise a centrally located contact area where they abut against each other. The upper portion and the lower portion are separated from each other by two gaps running on each side from the contact area to the lateral ends of the pressure ram member portions with a continuously increasing width. The press brake further comprises at least two operating cylinders mounted in the frame structure and operatively connected to the upper portion of the pressure ram member in the region of the two lateral ends thereof for driving the pressure ram member to a motion against the stationary ram member and for retracting the pressure ram member vertically back from the stationary ram member.

According to a second aspect of the invention, in order to achieve essentially the same objects, the invention provides a hydraulically operated press brake comprising a frame structure, a pressure ram member mounted in the frame structure to be vertically movable, a stationary ram member mounted in the frame structure, and at least two operating cylinders mounted in the frame structure and operatively connected to the pressure ram member in the region of the two lateral ends thereof for driving the pressure ram member to a motion against the stationary ram member and for retracting the pressure ram member vertically back from the stationary ram member.

The stationary ram member is divided into a first upper portion and a second lower portion along a plane essentially running perpendicular to the direction of motion of the pressure ram member.

Both the upper portion and the lower portion of the stationary ram member comprise a centrally located contact area where the abut against each other. The upper portion and the lower portion are separated from each other by two gaps running on each side from the contact area to the lateral ends of the stationary ram member portions with a continuously increasing width. The lower portion of the stationary ram member is freely suspended in the frame structure of the press brake in the region of the two lateral ends thereof.

In this way, it is ensured that the ram members are evenly deflected under load in the same sense at the edges facing the working area and located opposite to each other by providing that the flexibility of the ram portion facing the work piece to be bent is increased towards the lateral ends thereof such that the related ram member portion inevitably takes a convex shape under load, in contrary to a one-part ram member which always will take a concave shape under the same conditions.

By a suitable selection of the course of the cross sectional area along the width of the ram member portions facing the working area, the section modulus of these portions can be adjusted such that the deflection lines of the two ram members essentially run parallel to each other under any load condition.

The measure proposed by the invention, i.e. the design the ram member as a two-part construction, may be realized either at the upper movable pressure ram member or at the lower stationary ram member or at both of them. In the last case, it is even possible to linearize the course of the deflection lines along the width of the ram members.

Furthermore, the effect of the measures according to the present invention is essentially independent of the fact whether the plane of movement of the movable pressure ram member extends vertically, horizontally or obliquely. Usually, this plane of movement extends horizontally in most press brakes, and in most cases the upper pressure ram member is movable while the lower ram member is stationary. Thereby, in such an arrangement, besides the pressure forces, also the weight of the ram members and the ram member portions, respectively, is must be taken into account in calculating or selecting the desired deflection characteristics of the ram members.

As the gap width is decreased with increasing load because the ram member portion facing the work piece to be bent is more and more deflected, the width of the gaps at the lateral ends of the ram member two-part in a no-load condition must be selected such that it corresponds approximately to the maximum deflection which is to be expected with a one-part ram member under the same conditions, i.e. under full load. Preferably, the gap width at the lateral ends of the ram member is at least the same as the amount of maximum deflection of a one-part ram member cooperating with the subdivided ram member under full load conditions. However, if both ram members cooperating with each other are of the two-part design, it is more preferable if the gap width at the lateral ends of the ram members is not more than the maximum deflection of a one-part ram member under the same conditions.

In certain embodiments, it may be advantageous to connect the two portions of a subdivided ram member to each other by carrier members. In the case of a press brake having a two-part upper pressure ram member, these carrier members can serve for loosely holding the two portions of the ram member together at the contact area thereof and to absorb the weight of the lower portion of the ram member. Preferably, these carrier members are located in the region of the lateral ends of the ram member, where they additionally serve as a means for aligning and stabilizing the lower portion of the ram member with regard to the upper portion thereof, for example to prevent the lower portion from tilting around the common contact area, especially with assymetric load.

Preferably, the carrier members are pivotally connected to the upper and lower portions of the pressure ram member and comprise sprag clutch means which become effective during the pressing operation. The sprag clutch means in the carrier members may comprise spring means which are dimensioned such that they slightly press the lower portion of the pressure ram member against the upper portion of the pressure ram member in a no-load condition of the press brake.

The above mentioned carrier members may be omitted if the two portions of the pressure ram member are rigidly connected to each other, e.g. by screws. However, even in this case, it may be advantageous to provide aligning and guiding means preferably located in the region of the lateral ends of the pressure ram member to align the position of the lower portion of the pressure ram member with reference to the upper portion.

The gaps preferably run along a sloping straight line from the central contact area to the lateral ends of the pressure ram member whereby the angle of inclination of the sloping straight line is selected in dependence on the section modulus of the pressure ram member in function of the length of the pressure ram member and corresponds essentially to the half of the average gradient of this function. In a first approach, these requirement leads to a design in which the lower edge of the lower portion of the pressure ram member is straight and runs horizontally and in which the entire pressure ram member has an overall height which decreases from its center to its lateral ends, whereby the angle of inclination of the gaps corresponds essentially to half of the average angle of inclination of the upper edge of the upper portion of the pressure ram member.

BRIEF DESCRIPTIONS OF THE DRAWINGS

In the following an embodiment of the invention will be further described, with reference to the accompanying drawings, in which.

DETAILED DESCRIPTION OF THE PREFERRED EMBODIMENT

Figure 2:
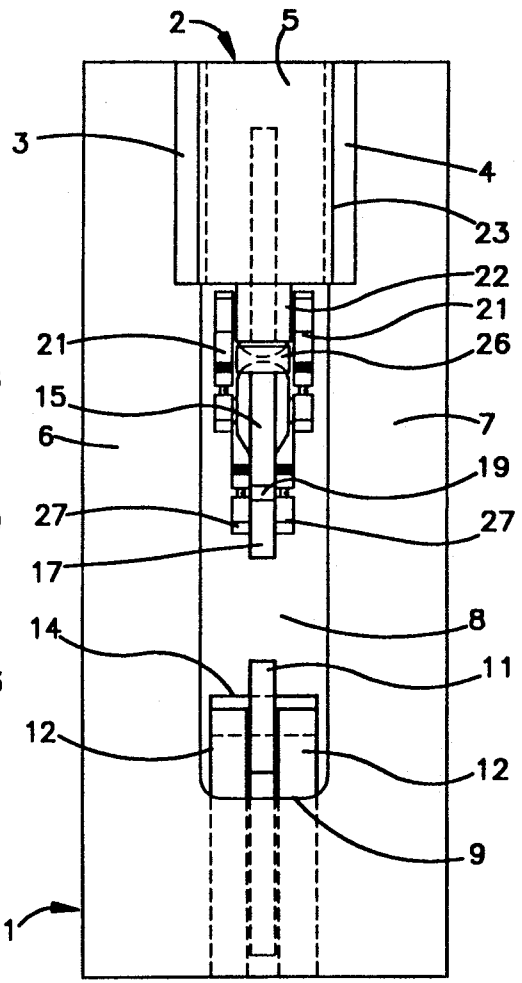
FIG. 2 shows a schematic side view of an embodiment of the press brake according to the invention.
Figure 1:
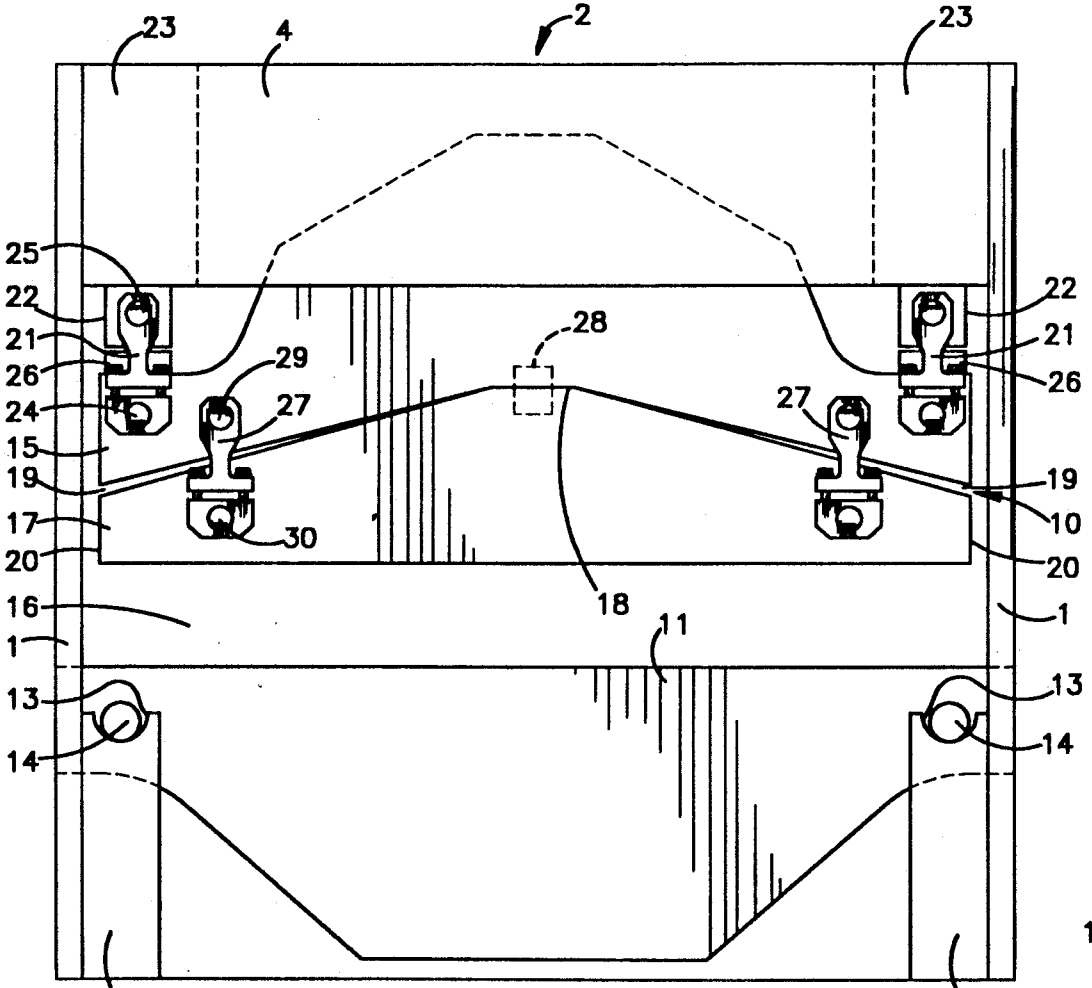
FIG. 1 shows a schematic front view of an embodiment of the press brake according to the invention.
Figure 3:
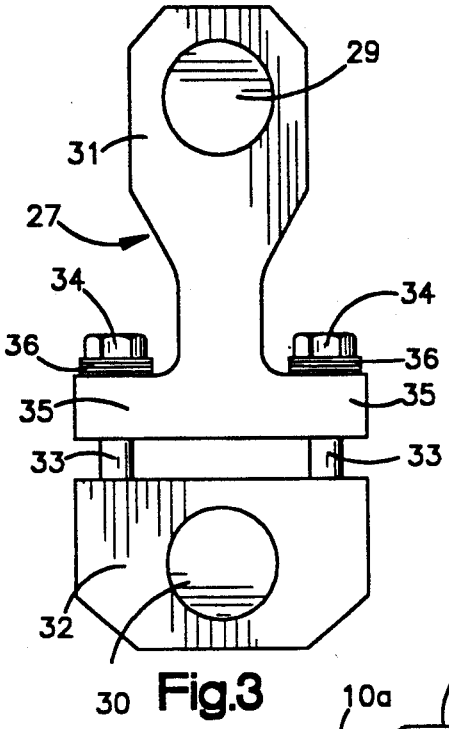
FIG. 3 shows a front view of an embodiment of a carrier member in a larger scale.

As can be seen in FIGS. 1 and 2, the press brake comprises a frame structure, essentially including two vertically extending lateral support members 1 and a cross beam 2 extending in horizontal direction and interconnecting the upper ends of the two vertical support members 1. The cross beam 2 has a box-like design and comprises two vertically extending longitudinal plate members 3 and 4, the two ends of them being interconnected by means of a vertically extending cross plate member 5. The lateral support members 1 each comprise two upright plate members 6 and 7 which are arranged in a certain distance from each other to leave a free space 8 between them. The plate members 6 and 7 are interconnected at their top by the cross beam 2 and at their bottom by means of a connecting member 9.

The active elements of the press brake are essentially constituted by a stationary ram member 11 and a vertically displaceable pressure ram member 10. Both the stationary ram member 11 and the pressure ram member 10 extend in horizontal direction between the two lateral support members 1 of the frame structure of the press brake into the free space 8 between the two plate members 6 and 7. It is understood that the stationary ram member 11 and the pressure ram member 10 are equipped with bending tools which are not shown in the drawings.

The stationary ram member 11 is generally designed as freely supported cross member. For this purpose, each one of the two connecting members 9 comprises two support members 12 mounted in a certain distance from each other on the corresponding connecting member 9 and being provided each with a bearing shell 13 having a concave cylindrical surface. The two lateral ends of the stationary ram member 11 have lateral end portions protruding into the space between the support members 12; these lateral end portions are provided with a cylindrical gudgeon pin 14 having two protruding ends resting in the bearing shells 13 of the support members 12.

The frame structure of the press brake is provided with two hydraulic cylinders 23 each comprising a piston (not shown) and a piston rod 22 for operating the pressure ram member 10 to a motion towards and away from the stationary ram member 11. These operating cylinders 23 are located in the region of the two lateral ends of the frame structure of the press brake. The pressure ram member 10 has two laterally protruding end portions. The pressure ram member 10 is suspended on the two piston rods 22 of the operating cylinders 23 by means of two carrier members 21. Each carrier member 21 has an upper end which is pivotally connected to the piston rod 22 of the related operating cylinder 23, and a lower end which is pivotally connected to the protruding end portion of the pressure ram member 10. The pivot shaft connecting the lower end of the carrier member 21 to the pressure ram member 10 is designated with reference numeral 24, while the pivot shaft connecting the upper end of the carrier member 21 to the piston rod 22 of the operating cylinder 23 is designated with reference numeral 25.

In order to transmit the pressure exerted by the piston rods 22 of the operating cylinders 23 to the pressure ram member 10, there is provided a pressure transmitting joint in the form of a double articulation assembly 26. Details regarding the design and construction of the double articulation assembly 26 have not to be explained here.

The pressure ram member 10 is separated into two parts as seen in the direction of pressure induction. Particularly, the pressure ram member 10 comprises an upper portion 15 and a lower portion 17. Both the upper and lower portions 15 and 17, respectively, comprise a centrally located contact area 18 in which they rest on each other. On both sides of this contact area 18, gaps 19 are provided between the upper portion 15 and the lower portion 17. Both gaps 19 continuously increase in width from zero directly near the contact area 18 to a certain value at the lateral ends 20 of the pressure ram member 10. The particular design of the gaps 19, especially also the gap width, will be discussed later in more detail.

As already mentioned, the upper portion 15 of the pressure ram member 10 is suspended on the two piston rods 22 of the operating cylinders 23 by means of carrier members 21. In a similar manner, the lower portion 17 of the pressure ram member 10 is suspended on the upper portion 15 by two carrier members 27. Each carrier member 27 has an upper end which is pivotally connected to the upper portion 15 of the pressure ram member 10, and a lower end which is pivotally connected to the lower portion 17 of the pressure ram member 10. The pivot shaft connecting the lower end of the carrier member 27 to the lower portion 17 of the pressure ram member 10 is designated with reference numeral 30, while the pivot shaft connecting the upper end of the carrier member 27 to the upper portion 15 of the pressure ram member 10 is designated with reference numeral 29. Thus, the upper and lower portions 15 and 17, respectively, are loosely hold together an rest on each other at the central contact area 18. The mutual position of the upper and lower portions 15 and 17, respectively, is additionally set by means of an alignment pin 28 which is received in recesses provided both in the upper and lower portions 15 and 17, respectively, in the central contact area 18.

Figure 4:
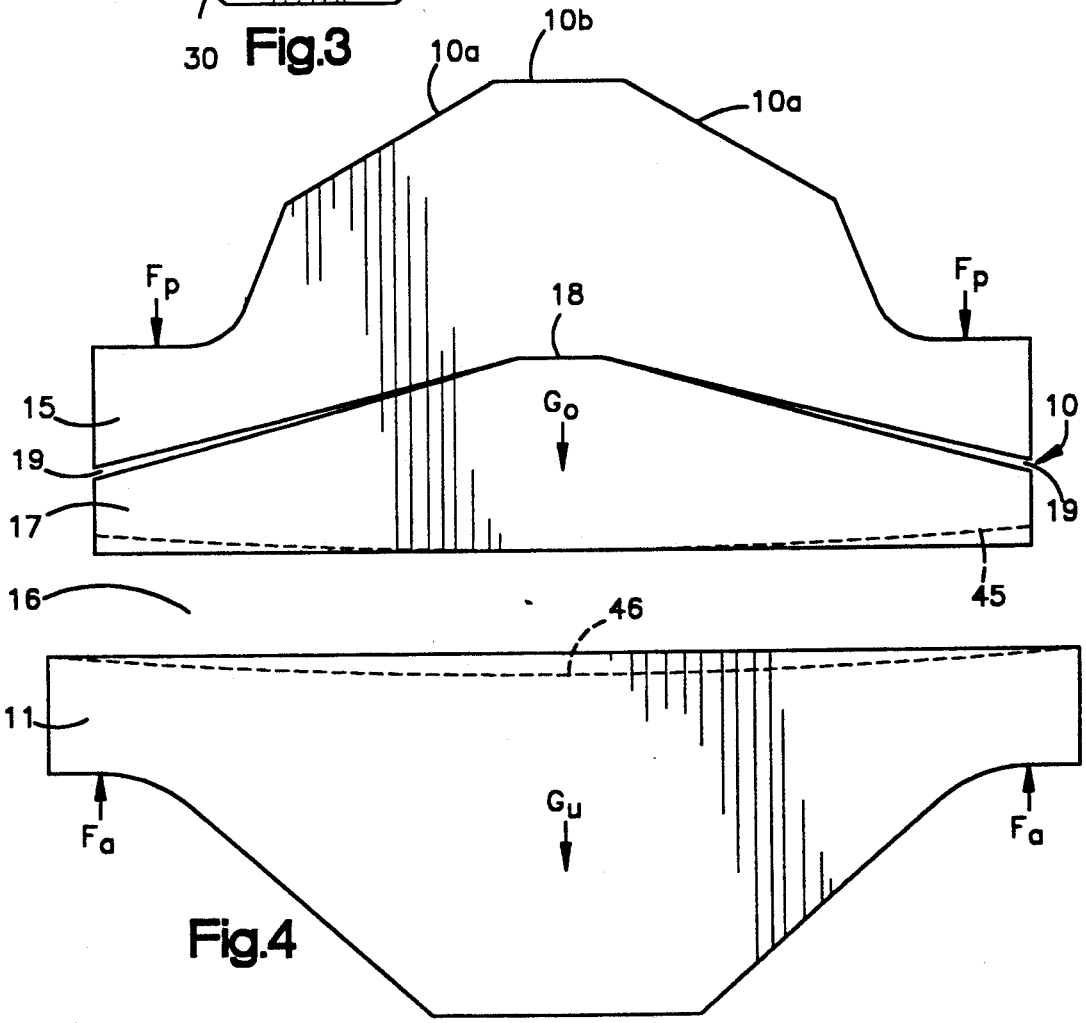
FIG. 4 shows a schematic view of the movable and the stationary rams of the press brake with indicated deflection lines under load.

A preferred embodiment of a carrier member 27 used to suspend the lower portion 17 of the pressure ram member 10 on the upper portion 15 is shown in FIG. 4. The same design of the carrier member 27 can also be applied for the carrier members 21 used to suspend the pressure ram member 11 on the piston rods 22 of the operating cylinders 23 and thereby bridging the pressure transmitting joint constituted by the double articulated joint assembly 26.

As can be seen in the drawing, the carrier member 21 is divided in the direction of power transmission into two parts, i.e. into an upper portion 31 pivotally connected to the pivot shaft 29 provided on the upper portion 15 of the pressure ram member 10 (cf. FIG. 1), and a lower portion 32 pivotally connected to the pivot shaft 30 provided on the lower portion 17 of the pressure ram member 11. The upper portion 31 and the lower portion 32 are loosely connected to each other by means of screw bolts 33 which freely penetrate the sideways directed legs 35 of the upper portion 31 and which are screwed into the lower portion 32. Between the heads 34 of the screw bolts 33 and the legs 35 of the upper portion, spring members 36, e.g. disk springs, are inserted. These spring members 36 exert a force onto the lower portion 32 of the carrier member 21 via the heads 34 and the screw bolts 33 such that the lower portion 32 is pulled against the upper portion 31. In the case of the carrier members 27, the spring force is selected such that the lower portion 17 of the pressure ram member 10 is slightly pressed against the upper portion 15 of the pressure ram member 10, and in the case of the carrier members 21, the spring force is selected such that the elements of the power transmitting articulated joint assembly 26 are slightly pressed together if the pressure ram member 10 is in a no-load condition, e.g. during fast forward or retraction of the pressure ram member 10.

The loose interconnection of the two portions 31 and 32 of the carrier member 27 forms a sprag clutch with the result that the pressure exerted by the piston rods 22 of the operating cylinders 23 is transmitted to the pressure ram member 11 only by the power transmitting articulated joint assembly 26 during the working stroke of the pressure ram member 10. Thereby, the carrier members 21 and 27 and their associated articulated joints are not subjected to any heavy strain by the pressure force. Further, it can be ensured that the lower portion 17 of the pressure ram member 10 keeps a stable position, i.e. that the lower portion 17 is subjected to a bending force during the pressing stroke of the pressure ram member 10, and it can be avoided that the lower portion 17 of the pressure ram member 10 tilts against the upper portion 15 of the pressure ram member 10.

In FIG. 4, the pressure ram member 10 comprising the upper and lower portions 15 and 17, respectively, and the stationary ram member 11 are separatly shown. Assuming the case that the pressure ram member 10 and the stationary ram member 11 are evenly loaded over the entire length of the two ram members 10 and 11, respectively, it may be expected that the stationary ram member 11 will be deflected along the deflection line 46 in FIG. 4. Due to the design of the pressure ram member as proposed by the invention, i.e. the subdivision of the pressure ram member 10 into two portions 15 and 17, respectively, which are separated by the two gaps 19, the lower portion 17 of the pressure ram member 10 will be deflected along the deflection line 45. It is understood that the deflection is shown greatly exaggerated; in practice, the maximum deflection is in the order of tenth of a millimeter or even less.

As can be seen in FIG. 4, the pressure ram member 10 and the stationary ram member 11 are deflected in the same sense under the influence of the pressing forces $F_p$, the support reaction forces $F_a$ and the weight $G_o$ of the pressure ram member 10 and $G_u$ of the stationary ram member 11, such that the deflection lines 45 and 46 run essentially parallel.

As already mentioned, the two gaps 19 extending from the central contact area 18 to the lateral ends of the pressure ram member 10 have continuously increasing width, starting from zero near the central contact area 18 and increasing to a predetermined value at the lateral ends. This predetermined value approximately corresponds to the maximum load deflection value occurring with the use of a one-part pressure ram member of identical dimensions, design and material, but should not be higher. This value can be calculated or can be found empirically by mounting a one-part test pressure ram member and measuring the maximum load deflection. Then, the actually used pressure ram member can be designed such that the gap width at the lateral ends corresponds approximately to the previously measured deflection value. In any case, the width of the gap 19 at the lateral ends must have a value corresponding at least to the deflection value of the undivided stationary ram member 11 under maximum pressure load conditions.

Preferably, the two gaps 19 each run along a straight line which is sloping downward from the central contact area 18 to the lateral ends of the pressure ram member 10. In other words, the cross section of the lower portion 17 of the pressure ram member 10 continuously decreases from the central contact area 18 toward the lateral ends. Preferably, the angle of inclination of the sloping straight lines is selected in dependence on the section modulus of the pressure ram member 10 in function of the length of the pressure ram member 10 and corresponds essentially to the half of the average gradient of this function. As can be seen in the drawings, the lower edge of the lower portion 17 of the pressure ram member 10, i.e. the edge facing the working area 16 of the press brake, is straight and runs horizontally, and the upper end of the pressure ram member 10 has an upper edge comprising a central horizontal portion **10*b* and two downwardly sloping portions 10*a* adjoining to the central portion 10*b*. Thus, the entire pressure ram member 10 has an overall height which decreases from its center to its lateral ends, whereby the angle of inclination of the gaps 19 corresponds essentially to half of the average angle of inclination of the upper edge portions 10*a* of the pressure ram member 10**.

Figure 5:
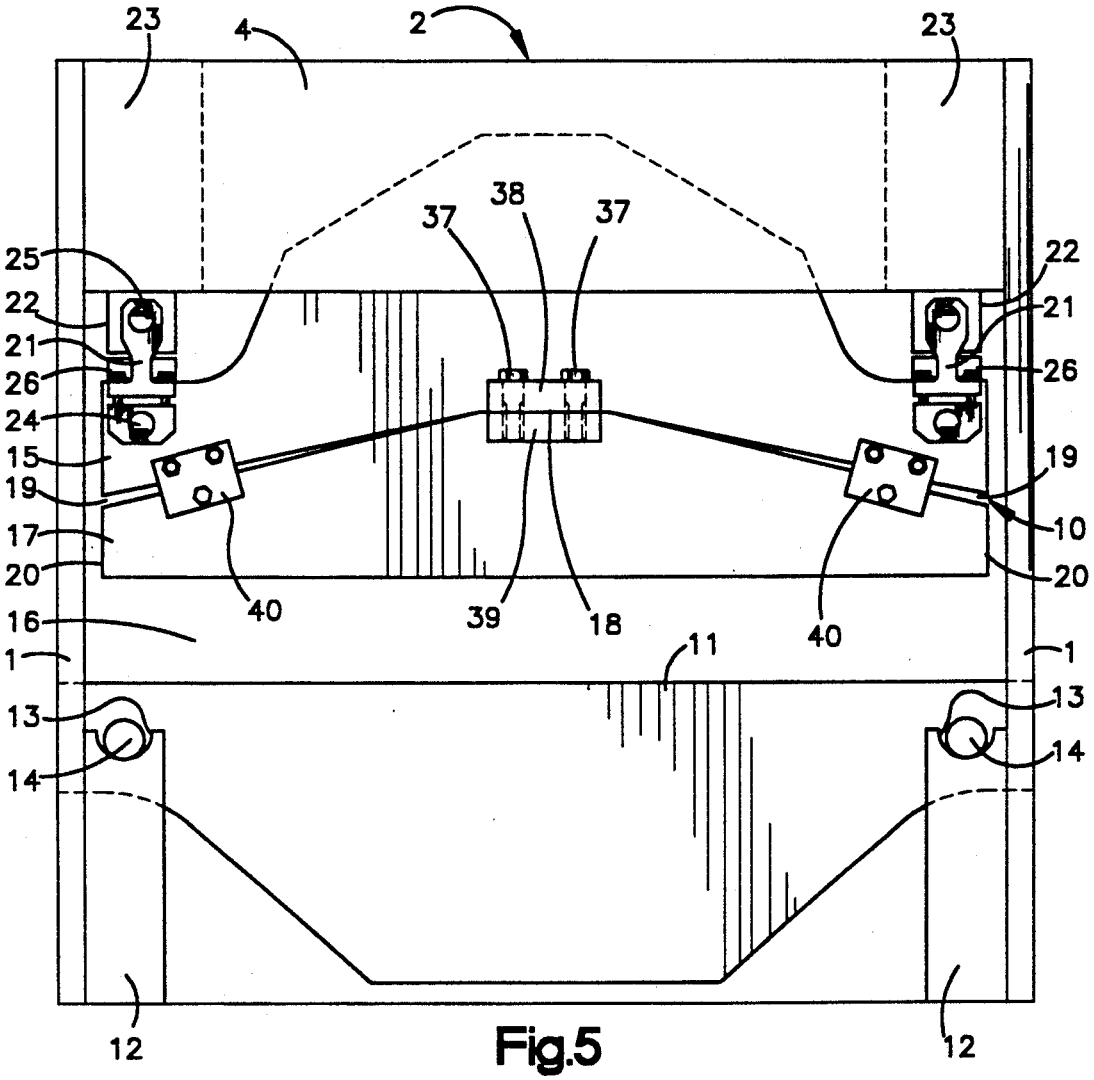
FIG. 5 shows a schematic front view of a second embodiment of the press brake according to the invention.

The press brake shown in FIG. 5 differs from the one shown in FIGS. 1 and 2 essentially by the means for keeping together the upper portion 15 and the lower portion 17 of the pressure ram member 10. In the embodiment shown in FIG. 5, the two carrier members 27 (cf. FIG. 1) are omitted and the upper and lower portions 15 and 17, respectively, of the pressure ram member 10 are rigidly fixed to each other in the region of the central contact area 18. For this purpose, the upper and lower portions 1 5 and 17, respectively, each comprise flange members 38 and 39 which are fixed to the front and rear sides, respectively, of the upper and lower portions 15 and 17, respectively, of the pressure ram member 10; each two adjacent flange members 38 and 39 are fixed to each other by means of screws 37. Alternatively, the flange members 38 and 39 can be omitted and the two portions 15 and 17, respectively, can be directly fixed to each other by means of screws. In this case, it is understood that e.g. the upper portion 15 must be provided with suitable recesses (not shown).

Figure 6:
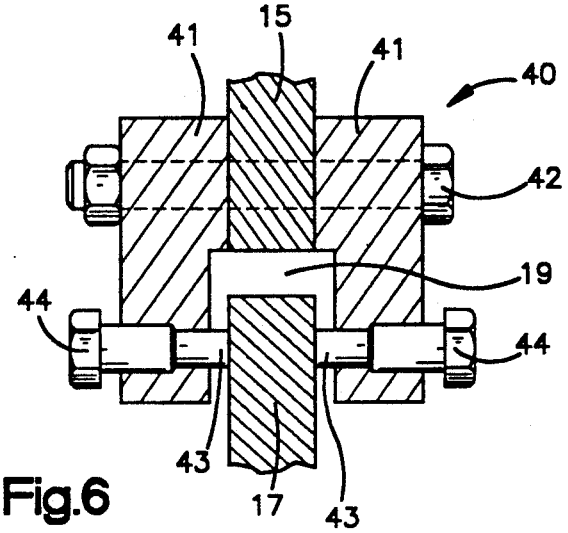
FIG. 6 shows a cross-sectional view of the aligning means.

In the embodiment shown in FIG. 5, means 40 are provided for aligning the position and for guiding the upper and lower portions 15 and 17, respectively, with reference to each other. As can be seen from FIG. 6, theses aligning and guiding means 40 comprise two plate members 41 mounted by means of screws 42 on the upper portion 15 of the pressure ram member 10 and bridging the gap 19 between the upper and lower portions 15 and 17, respectively. The lower ends of the plate members 41 overlapping the lower portion 17 of the pressure ram member 10 are provided with aligning and guiding pins 43 which are axially adjustable by means of set screws 44. The set screws 44 are adjusted such that the aligning and guiding pins 43 loosely contact the front and back surfaces of the lower portion 17 of the pressure ram member 10.

Figure 7:
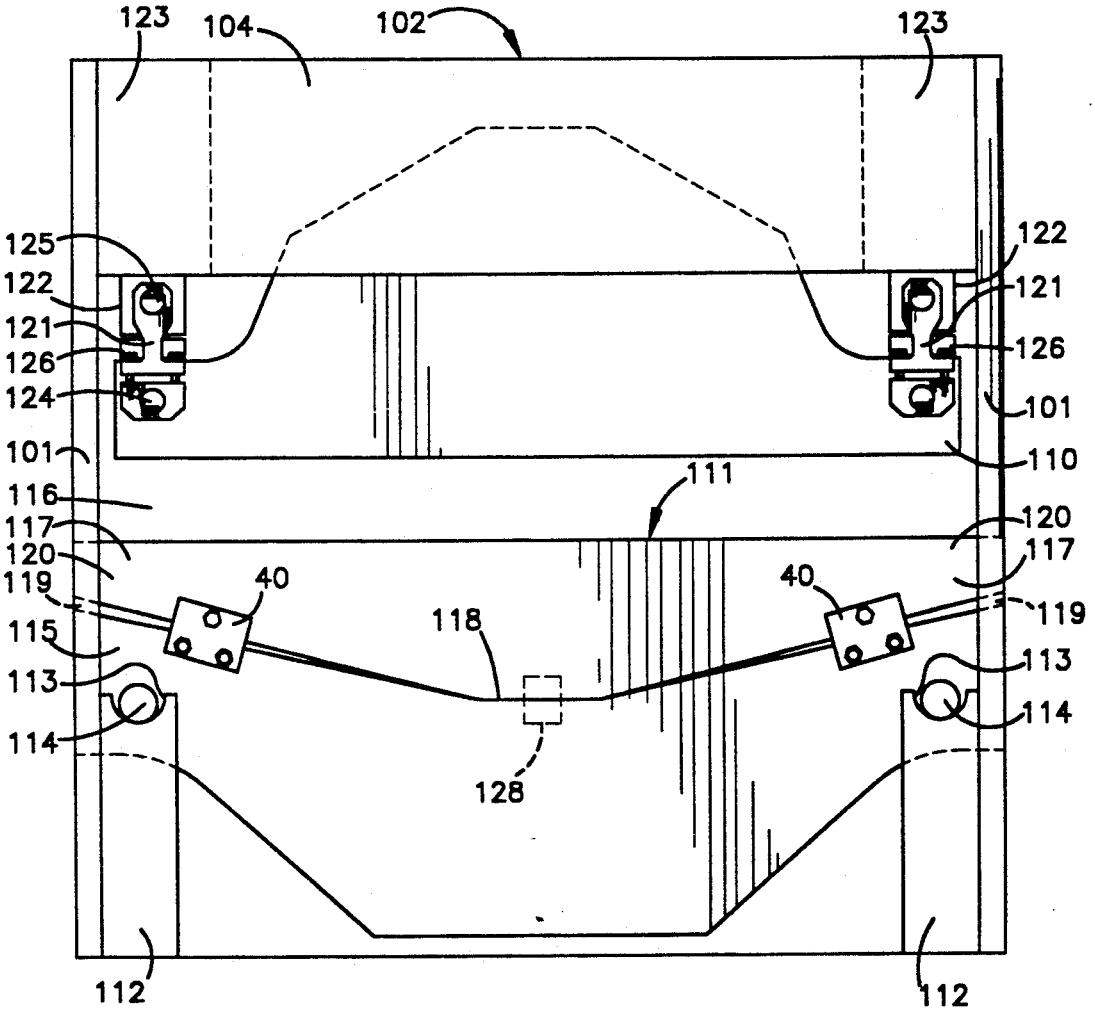
FIG. 7 shows a schematic front view of a third embodiment of the press brake according to the invention.

In FIG. 7, there is shown a further embodiment of a press brake according to the invention. The press brake comprises a frame structure, essentially including two vertically extending lateral support members 101 and a cross beam 102 extending in horizontal direction and interconnecting the upper ends of the two vertical support members 101. The cross beam 102 has a box-like design and comprises two vertically extending longitudinal plate members 103 and 104, the two ends of them being interconnected by means of a vertically extending cross plate member 105. The lateral support members 101 each comprise two upright plate members 106 and 107 which are arranged in a certain distance from each other to leave a free space 108 between them. The plate members 106 and 107 are interconnected at their top by the cross beam 102 and at their bottom by means of a connecting member 109.

The active elements of the press brake are essentially constituted by a stationary ram member 111 and a vertically displaceable pressure ram member 110. Both the stationary ram member 111 and the pressure ram member 110 extend in horizontal direction between the two lateral support members 101 of the frame structure of the press brake into the free space 108 between the two plate members 106 and 107. It is understood that the stationary ram member 111 and the pressure ram member 110 are equipped with bending tools which are not shown in the drawings.

The stationary ram member 111 is generally designed as freely supported cross member comprising an upper portion 117 and a lower portion 115. For this purpose, each one of the two connecting members 109 comprises two support members 112 mounted in a certain distance from each other on the corresponding connecting member 109 and being provided each with a bearing shell 113 having a concave cylindrical surface. The two lateral ends of the lower portion 115 of the stationary ram member 111 have lateral end portions protruding into the space between the support members 112; these lateral end portions are provided with a cylindrical gudgeon pin 114 having two protruding ends resting in the bearing shells 113 of the support members 112.

The frame structure of the press brake is provided with two hydraulic cylinders 123 each comprising a piston (not shown) and a piston rod 122 for operating the pressure ram member 110 to a motion towards and away from the stationary ram member 111. These operating cylinders 123 are located in the region of the two lateral ends of the frame structure of the press brake. The pressure ram member 110 has two laterally protruding end portions. The pressure ram member 110 is suspended on the two piston rods 122 of the operating cylinders 123 by means of two carrier members 121. Each carrier member 121 has an upper end which is pivotally connected to the piston rod 122 of the related operating cylinder 123, and a lower end which is pivotally connected to the protruding end portion of the pressure ram member 110. The pivot shaft connecting the lower end of the carrier member 121 to the pressure ram member 110 is designated with reference numeral 124, while the pivot shaft connecting the upper end of the carrier member 121 to the piston rod 122 of the operating cylinder 123 is designated with reference numeral 125.

In order to transmit the pressure exerted by the piston rods 122 of the operating cylinders 123 to the pressure ram member 110, there is provided a pressure transmitting joint in the form of a double articulation assembly 126. Details regarding the design and construction of the double articulation assembly 126 have not to be explained here.

The stationary ram member 111 is separated into two parts as seen in the direction of pressure induction. Particularly, the stationary ram member 111 comprises an upper portion 115 and a lower portion 117. Both the upper and lower portions 115 and 117, respectively, comprise a centrally located contact area 118 in which they rest on each other. On both sides of this contact area 118, gaps 119 are provided between the upper portion 115 and the lower portion 117. Both gaps 119 continuously increase in width from zero directly, near the contact area 118 to a certain value at the lateral ends 120 of the stationary ram member 111. The particular design of the gaps 119, especially also the gap width, have already been discussed in more detail hereinbefore and the same applies accordingly to the embodiment according to FIG. 7.

The upper and lower portions 115 and 117, respectively, of the stationary ram member 111 loosely rest on each other at the central contact area 118. The mutual position of the upper and lower portions 115 and 117, respectively, is additionally set by means of an alignment pin 128 which is received in recesses provided both in the upper and lower portions 115 and 117, respectively, in the central contact area 18. For additionally aligning and guiding the upper and lower portions 115 and 117, respectively, of the stationary ram member 111, there are provided two aligning and guiding members 40; these can be of the same design and construction as hereinbefore discussed with reference to FIG. 6.

Otherwise, the remarks and explanations given hereinbefore also apply correspondingly to the embodiment of FIG. 7, particularly as far as the deflection and the gap width are concerned.

Finally, is should be mentioned that a design of a press brake is also possible which has a two-part pressure ram member, e.g. like the embodiment in FIG. 1 or 5, as well as a two-part stationary ram member, e.g. like the embodiment of FIG. 7.

What is claimed is:

1. A hydraulically operated press brake comprising:

a frame structure;

a pressure ram member mounted in said frame structure to be vertically movable;

a stationary ram member mounted in said frame structure;

said pressure ram member being divided into a first upper portion and a second lower portion along a plane essentially running perpendicular to the direction of motion of said pressure ram member;

both said upper portion and said lower portion of said pressure ram member comprising a centrally located contact area where they abut against each other, said upper portion and said lower portion being separated from each other by a gap running on each side from said contact area to lateral ends of said upper and lower portions of said pressure ram member with a continuously increasing gap width; and at least two operating cylinders mounted in said frame structure and operatively connected to said upper portion of said pressure ram member in the region of the two lateral ends thereof for driving said pressure ram member to a motion against said stationary ram member and for retracting said pressure ram member vertically back from said stationary ram member.

2. A press brake according to claim 1 wherein a cross section of said lower portion varies along a horizontal width of said lower portion facing a working area such that a deflection line of said pressure ram member matches a deflection line of said stationary ram member when said pressure ram member is pressed against said stationary ram member.

3. A press brake according to claim 1 wherein the width of said gaps in the regions of the lateral ends of said divided pressure ram member in a no-load condition essentially corresponds to the amount of maximum deflection observed when an undivided pressure ram member is under load.

4. A press brake according to claim 3 wherein the width of said gaps in the regions of the lateral ends of said divided pressure ram member in a no-load condition is at least as large as the maximum deflection of said stationary ram member cooperating with said divided pressure ram member under maximum load.

5. A press brake according to claim 1 wherein the width of said gaps in the regions of the lateral ends of said divided pressure ram member in a no-load condition is at most as large as the amount of maximum deflection observed when an undivided pressure ram member is under load.

6. A press brake according to claim 1 wherein said upper and lower portions of said pressure ram member are coupled to each other by means of carrier members.

7. A press brake according to claim 6 wherein said carrier members are located in the regions of the lateral ends of said upper and lower portions of said pressure ram member.

8. A press brake according to claim 6 wherein said carrier members are pivotally connected to said upper and lower portions of said pressure ram member.

9. A press brake according to claim 6 wherein said carrier members comprise sprag clutch means which becomes effective during a pressing operation.

10. A press brake according to claim 9 wherein said sprag clutch means in said carrier members comprises spring means.

11. A press brake according to claim 10 wherein said spring means is dimensioned such that said spring means slightly presses said lower portion of said pressure ram member against said upper portion of said pressure ram member in a non-load condition of the press brake.

12. A press brake according to claim 1 wherein said upper and lower portions of said pressure ram member are rigidly connected to each other in the region of said centrally located contact area.

13. A press brake according to claim 1 further comprising means for aligning said upper and lower portions of said pressure ram member with respect to each other, said aligning means being located in the regions of the lateral ends of said pressure ram member.

14. A press brake according to claim 1 wherein said gaps run along a sloping straight line from said centrally located contact area to the lateral ends of said pressure ram member.

15. A press brake according to claim 14 wherein the angle of inclination of said sloping straight line depends upon the section modulus of said pressure ram member, the section modulus varying as a function of the length of said pressure ram member and corresponding essentially to half of the average gradient of this function.

16. A press brake according to claim 15 wherein a lower edge of said lower portion of said pressure ram member is straight and runs horizontally, said pressure ram member having an overall height which decreases from said centrally located contact area to the lateral ends of said pressure ram member, the angle of inclination of said gaps corresponding essentially to half of the average angle of inclination of an upper edge of said upper portion of said pressure ram member.

17. A hydraulically operated press brake comprising:

a frame structure;

a pressure ram member mounted in said frame structure to be vertically movable;

a stationary ram member mounted in said frame structure;

at least tow operating cylinders mounted in said frame structure and operatively connected to said pressure ram member in the region of two lateral ends thereof for driving said pressure ram member to a motion against said stationary ram member and for retracting said pressure ram member vertically back from said stationary ram member;

said stationary ram member being divided into a first upper portion and a second lower portion along a plane essentially running perpendicular to the direction of motion of said pressure ram member;

both said upper portion and said lower portion of said stationary ram member comprising a centrally located contact area where they abut against each other, said upper portion and said lower portion being separated from each other by a gap running on each side from said contact area to lateral ends of said upper and lower portions of said stationary ram member with a continuously increasing gap width, said lower portion of said stationary ram member being freely suspended in said frame structure in the region of the two lateral ends thereof.

* * * * *